US009076608B2

(12) United States Patent
Miwa et al.

(10) Patent No.: US 9,076,608 B2
(45) Date of Patent: Jul. 7, 2015

(54) PUSH SWITCH

(75) Inventors: Toshitaka Miwa, Miyagi-Ken (JP); Hiroki Suzuki, Miyagi-Ken (JP)

(73) Assignee: ALPS ELECTRIC CO., LTD., Tokyo (JP)

( * ) Notice: Subject to any disclaimer, the term of this patent is extended or adjusted under 35 U.S.C. 154(b) by 112 days.

(21) Appl. No.: 13/114,295

(22) Filed: May 24, 2011

(65) Prior Publication Data

US 2011/0284353 A1 Nov. 24, 2011

(30) Foreign Application Priority Data

May 24, 2010 (JP) ..... 2010-118554

(51) Int. Cl.

| | |
|---|---|
| ***H01H 23/04*** | (2006.01) |
| ***H01H 13/02*** | (2006.01) |
| ***H01H 13/60*** | (2006.01) |
| *H01H 13/56* | (2006.01) |

(52) U.S. Cl.

CPC ..... *H01H 13/023* (2013.01); *H01H 13/60* (2013.01); *H01H 13/562* (2013.01); *H01H 2300/01* (2013.01)

(58) Field of Classification Search

USPC ..... 200/523–525, 547–549, 303, 345

See application file for complete search history.

(56) References Cited

U.S. PATENT DOCUMENTS

| | | | | |
|---|---|---|---|---|
| 3,732,386 | A * | 5/1973 | Ohkita | 200/524 |
| 5,564,559 | A * | 10/1996 | Chen | 200/339 |
| 5,647,478 | A * | 7/1997 | Hirai | 200/303 |

FOREIGN PATENT DOCUMENTS

| | | |
|---|---|---|
| JP | 59-8267 | 3/1984 |
| JP | 61-078019 | 4/1986 |
| JP | 05-166435 | 7/1993 |
| JP | 2005-183175 | 7/2005 |
| JP | 2006-120469 | 5/2006 |

OTHER PUBLICATIONS

Decision to Grant from corresponding Japanese Application No. 2010-118554 mailed Sep. 3, 2013.

* cited by examiner

*Primary Examiner* — Renee Luebke
*Assistant Examiner* — Ahmed Saeed
(74) *Attorney, Agent, or Firm* — Hunton & Williams LLP

(57) ABSTRACT

A push switch includes an operating slider, an actuator with a sliding member, a return spring, a housing, a main body in which the operating slider, the actuator, and the return spring are supported by the housing, a heart cam mechanism (including an engagement pin and a cam groove) incorporated in the main body, an operating knob which caps the operating slider, and a fixed contact provided for a circuit board such that the sliding member is allowed to be brought into contact with and separated from the fixed contact. When the operating slider is moved upward or downward, the actuator is driven to be laterally slid. The housing is snap-fitted to an outer casing (upper casing) holding the circuit board. A space is provided between the housing and the circuit board.

4 Claims, 9 Drawing Sheets

PUSH SWITCH

CROSS-REFERENCE TO RELATED APPLICATIONS

This application contains subject matter related to and claims benefit of Japanese Patent Application No. 2010-118554 filed on May 24, 2010, which is hereby incorporated by reference.

BACKGROUND OF THE DISCLOSURE

1. Field of the Disclosure

The present disclosure relates to a push switch with a locking mechanism, and in particular, relates to a push switch in which an actuator is slid in a direction substantially orthogonal to the direction in which the switch is pushed to switch between ON and OFF states.

2. Description of the Related Art

A push switch with a locking mechanism is designed such that when an operating member is pushed to turn on the switch (ON state), the operating member is locked in this state, and when the operating member is again pushed, the locked state is unlocked and the switch is returned to its OFF state. If a long actuation stroke is set, the push switch is often pushed with a relatively large operating force. Regarding the lock mechanism, for example, a heart cam mechanism in which an engagement pin is slid along a heart-shaped cam groove is used. In this kind of push switch, an operating slider integrated with the operating member is supported by a housing such that the slider is slidable in the direction (hereinafter, "push operation direction") in which the operating member is pushed. Since the actuation stroke of the operating slider is set to long, the amount of protrusion of the operating slider from the housing in the ON state is small and that in the OFF state is large. Moreover, since an action of the operating slider during push operation for the ON state completely differs from that for the OFF state, the ON state and the OFF state can be clearly distinguished from each other visually or based on a sense of operation. Accordingly, such a push switch is widely used as a switch device for temporarily preventing, for example, power windows of an automobile from being opened or closed.

In addition, as a push switch which does not include a lock mechanism and in which an operating slider slides an actuator laterally (in a direction substantially orthogonal to the push operation direction) during push operation to switch between the ON and OFF states, there is known a push switch having a configuration in which fixed contacts are arranged on the inner bottom of a housing receiving the actuator having movable contacts and part of the actuator is slid on a diagonally extending guide surface included in the operating slider (for example, refer to Japanese Examined Utility Model Registration Application Publication No. 59-8267). In this related-art push switch, the operating slider is elastically urged in the direction opposite to the push operation direction by a return spring at all times. When the operating slider is pushed into the housing by a predetermined stroke against the elastic force of the spring, the operating slider moving in the push operation direction laterally drives the actuator, so that the movable contacts come into contact with predetermined fixed contacts. Consequently, an ON signal can be extracted through terminals leading from the fixed contacts to the outside of the housing. Accordingly, if the actuation stroke of this kind of push switch is set to long, the height of the housing can be prevented from increasing. This kind of push switch is used while the housing is mounted on a circuit board and a group of terminals are soldered to a corresponding land. The operating slider of the push switch is disposed orthogonal to the circuit board.

Since the related-art push switch, configured such that the actuator with the movable contact is laterally slid by the operating slider during push operation, is mounted on the circuit board and the group of terminals is soldered to the land, the circuit board directly receives an operating load during push operation. Specifically, the operating load during push operation is applied to a portion of the circuit board on which the housing of the push switch is mounted and on which the terminals are soldered to. Accordingly, when the operating slider of the push switch is pushed by a large operating physical force, the circuit board is deflected, so that a soldered joint may be cracked.

In particular, when this kind of push switch is provided with a lock mechanism, a relatively large operating physical force may be applied to the switch during normal push operation. Accordingly, the risk of cracking the soldered joint on the circuit board due to the operating load is increased. Disadvantageously, the reliability may be forced to decrease.

These and other drawbacks exist.

SUMMARY OF THE DISCLOSURE

The present disclosure has been made in consideration of the above-described drawbacks. The present disclosure provides a push switch with a locking mechanism in which the height of a housing can be prevented from increasing even when an actuation stroke is set to long and the reliability of conduction is not reduced even if an excessive operating load is applied to the switch.

According to an aspect of the present disclosure, a push switch includes an operating slider integrated with an operating member, the operating slider having an inclined guide surface extending obliquely on one side wall thereof, a housing supporting the operating slider such that the operating slider is slidable in a push operation direction, and an actuator supported in the housing. The actuator includes a driven portion slidable on the inclined guide surface and is driven by the operating slider to be slidable in a direction substantially orthogonal to the push operation direction. The push switch further includes a conductive sliding member attached to the actuator such that the sliding member is exposed on the housing, a return spring supported in the housing such that the return spring elastically urges the operating slider in the direction opposite to the push operation direction at all times, a heart cam mechanism including a cam groove provided for either one of a side wall opposite the one side wall of the operating slider and the housing and an engagement pin journaled by the other one such that the engagement pin is slidably engaged with the cam groove, and a fixed contact provided for a circuit board such that the sliding member is allowed to be brought into contact with and separated from the fixed contact. The housing is fixed to an outer casing holding the circuit board to dispose the housing apart from the circuit board and bring the sliding member into elastic contact with the circuit board.

In the push switch with the above-described configuration, the housing is attached to the outer casing and a space is provided between the housing and the circuit board. Accordingly, an operating load applied to the operating slider acts on the outer casing through the housing and the operating load hardly acts on the circuit board. If an excessive operating load is applied, therefore, there is no fear of occurrence of damage, e.g., a crack in a soldered joint caused by deflection of the circuit board. Further, since the space is provided between the housing and the circuit board, a circuit pattern and electronic components can be arranged in an area in the space, thus increasing an effective area in the circuit board. Moreover, if the position of the fixed contact on the circuit board is shifted, the timing when the sliding member is brought into contact with or separated from the fixed contact can be changed. Accordingly, the timing of switching to the ON state can be easily adjusted depending on the intended use of the push switch. In addition, the actuator is slid in the direction substantially orthogonal to the push operation direction to switch the push switch between the ON and OFF states. Accordingly, if an actuation stroke for the operating slider is set to long, the height of the housing can be prevented from increasing. Further, the heart cam mechanism provided for the push switch allows the engagement pin journaled by either one of the operating slider and the housing to be slid along the cam groove provided for the other one. Advantageously, the heart cam mechanism functions as a lock mechanism with a simple configuration and good space factor.

With the above-described configuration, the housing may be fixed, e.g., screwed to the outer casing. The outer casing can include an attachment frame such that the attachment frame extends vertically upwardly and downwardly therefrom, the attachment frame has a fastening hole, the housing includes an engagement hook protruding from the outer surface of a side wall thereof, and the engagement hook is snap-fitted into the fastening hole to fix the housing to the attachment frame. Advantageously, the housing can be easily attached to the outer casing so as to be placed in a predetermined position therein.

In the above-described configuration, a first inclined guide surface and a second inclined guide surface facing each other with a recessed groove obliquely extending therebetween may be provided for the one side wall of the operating slider, the driven portion of the actuator disposed in the recessed groove may be driven by the first inclined guide surface in accordance with the movement of the operating slider in the push operation direction to move in one direction along the recessed groove, and the driven portion may be driven by the second inclined guide surface in accordance with the movement of the operating slider in the direction opposite to the push operation direction to move in the opposite direction along the recessed groove. Advantageously, the operating slider and the actuator, which are slid in the directions substantially orthogonal to each other, can be drivingly connected to each other smoothly at all times. In addition, this arrangement provides a power converting mechanism with a simple configuration and good space factor. In this case, the first and second inclined guide surfaces may be provided for one of substantially parallel side walls of the operating slider and the other side wall may face the engagement pin. Accordingly, the actuator can be disposed in a space which the one side wall of the operating slider faces in the housing and the engagement pin can be disposed in a space which the other side wall substantially parallel to the one side wall faces. Consequently, the actuator and the engagement pin can be arranged relative to the operating slider in a balanced manner, so that the operation of the push switch can be easily stabilized. In addition, the housing can be easily made compact.

DETAILED DESCRIPTION OF THE DISCLOSURE

The following description is intended to convey a thorough understanding of the embodiments described by providing a number of specific embodiments and details involving a push switch. It should be appreciated, however, that the present invention is not limited to these specific embodiments and details, which are exemplary only. It is further understood that one possessing ordinary skill in the art, in light of known systems and methods, would appreciate the use of the invention for its intended purposes and benefits in any number of alternative embodiments, depending on specific design and other needs.

Figure 3:
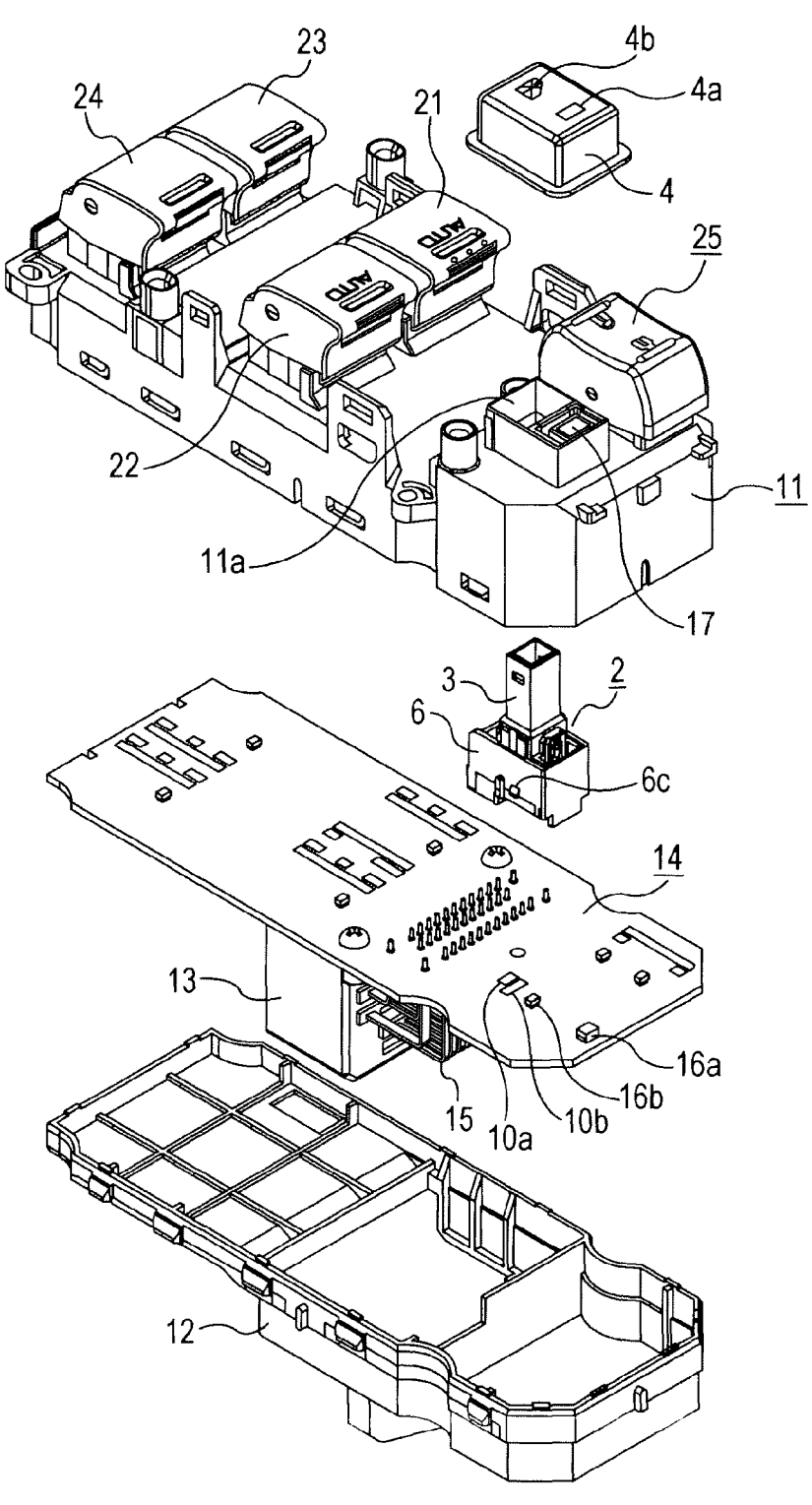
FIG. 3 is an exploded perspective view of the switch unit.
Figure 4:
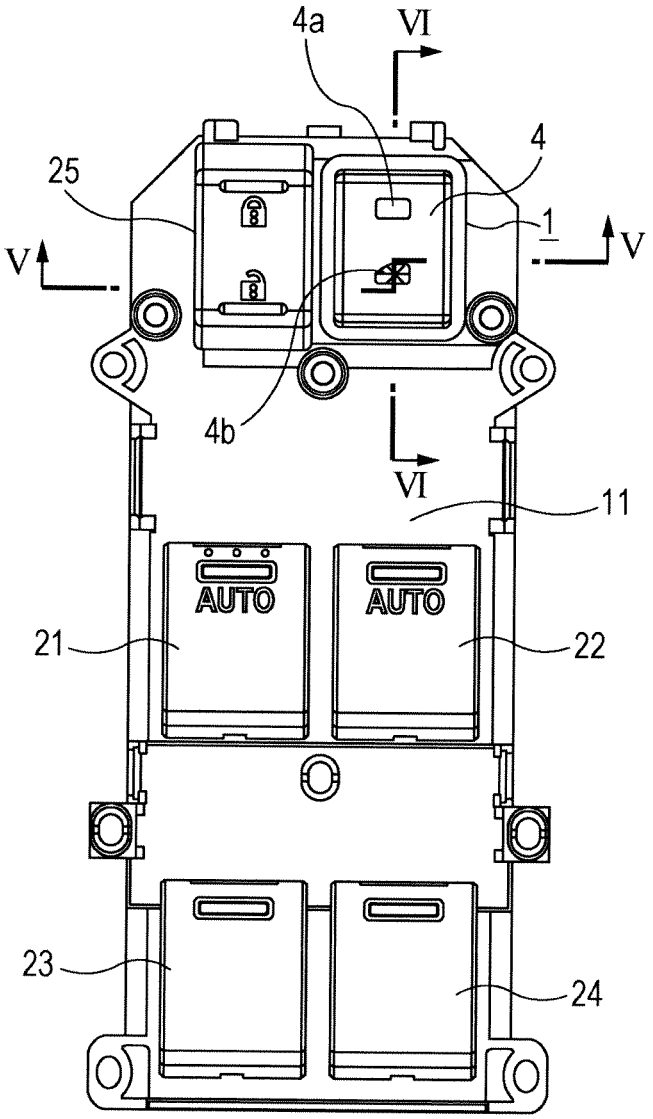
FIG. 4 is a top view of the switch unit.

Various embodiments of the disclosure will be described below with reference to FIGS. 1 to 12. A switch unit illustrated in FIGS. 2 to 4 may be attached to the inside of a door of an automobile. This switch unit may include a plurality of switch devices including a push switch 1 according to this embodiment. Specifically, the switch unit may include four switch devices 21 to 24 which can be pulled and pushed to close and open a power window, a seesaw switch 25 which can be swung to switch the doors between a locked state and an unlocked state, and the push switch 1 which can be pushed to prevent the power windows from being opened or closed. An outer casing assembly of the switch unit may include three casings, i.e., an upper casing 11, a lower casing 12, and a connector casing 13. These three casing 11 to 13 may be combined into one using fixing means, such as snap fitting. In addition, a circuit board 14 which may be screwed on the connector casing 13 may be incorporated in the outer casing assembly. The circuit board 14 may be electrically connected to an external circuit through a group of connection terminals 15 (as shown in FIG. 3, for example). The switch devices 21 to 25 other than the push switch 1 may not be directly concerned with the disclosure. Accordingly, the configurations and actions thereof are omitted.

Figure 1:
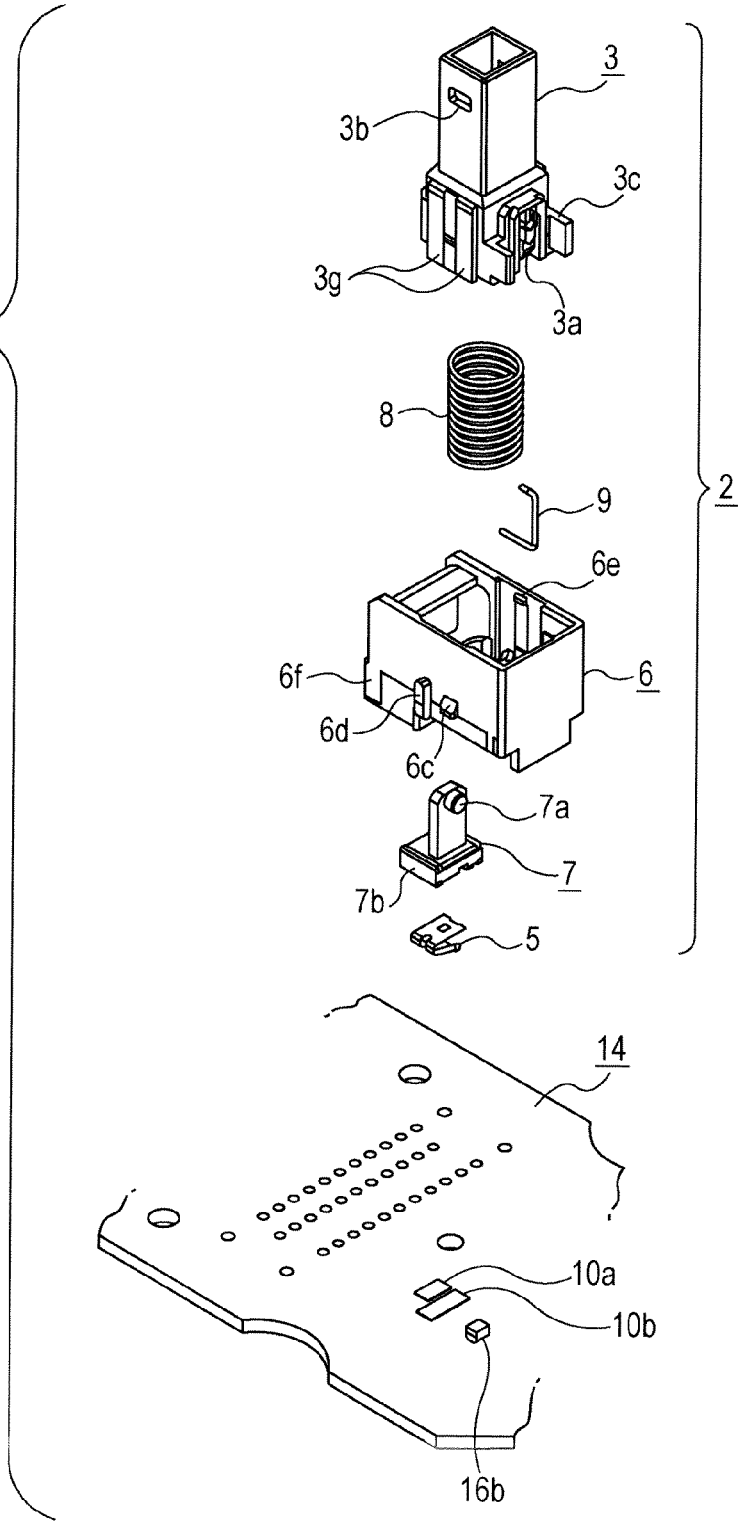
FIG. 1 is an exploded perspective view of a push switch according to an embodiment of the disclosure.
Figure 2:
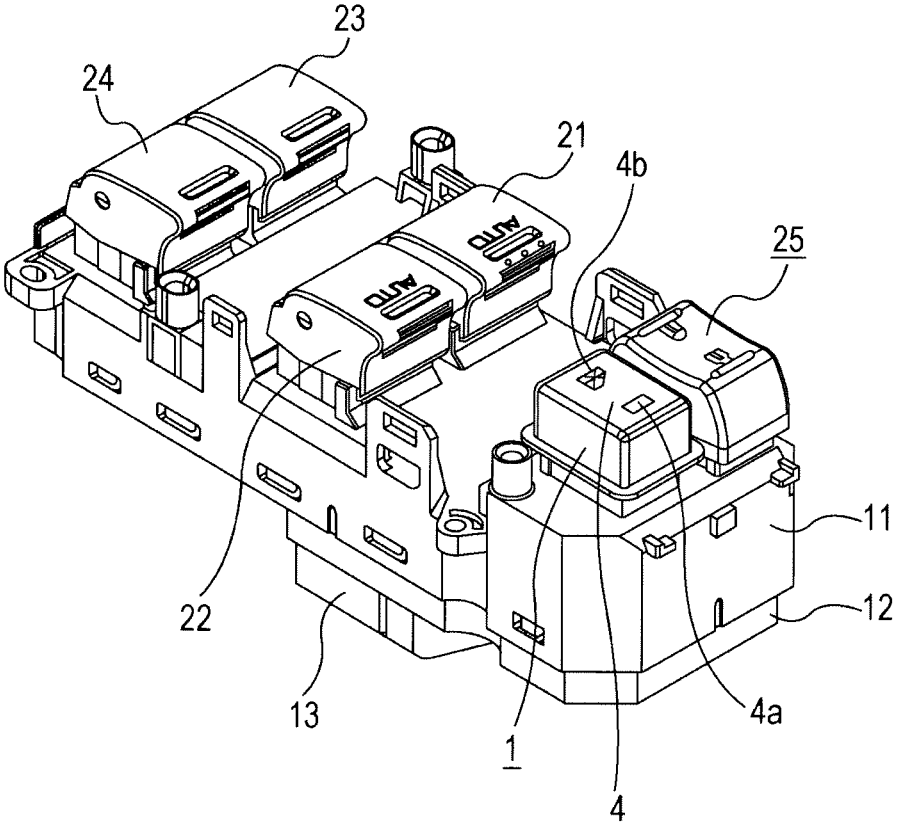
FIG. 2 is a perspective view of a switch unit including the push switch.

Referring to FIG. 3, the push switch 1 may include a main body 2 which may be unitized and can be used as a single component, an operating knob 4 which caps an operating slider 3 of the main body 2 and may serve as an operating member, and fixed contacts 10*a* and 10*b* arranged on the circuit board 14. A sliding member 5 provided for the main body 2 may be slidable on the fixed contacts 10*a* and 10*b*. As will be described in detail later, the sliding member 5 may be allowed to be brought into contact with and separated from the fixed contact 10*a* and the sliding member 5 may be in contact with the fixed contact 10*b*, serving as a common contact, at all times. Referring to FIG. 1, the main body 2 may include the operating slider 3 to which the operating knob 4 may be attached and which may be shaped in a rectangular column, a box-shaped housing 6 which may support the operating slider 3 such that the operating slider 3 is slidable in a push operation direction (downward), an actuator 7 which may be supported in the housing 6 such that the actuator is slidable laterally, i.e., substantially orthogonal to the push operation direction, the sliding member 5 which may be conductive and may be attached to the actuator 7 so as to downwardly project from the housing 6, a return spring 8 which may be supported in the housing 6 and elastically urge the operating slider 3 in the direction (upward) opposite to the push operation direction at all times, and an engagement pin 9, one end of the engagement pin 9 being journaled by the housing 6, the other end thereof being slidably engaged with the operating slider 3.

Figure 6:
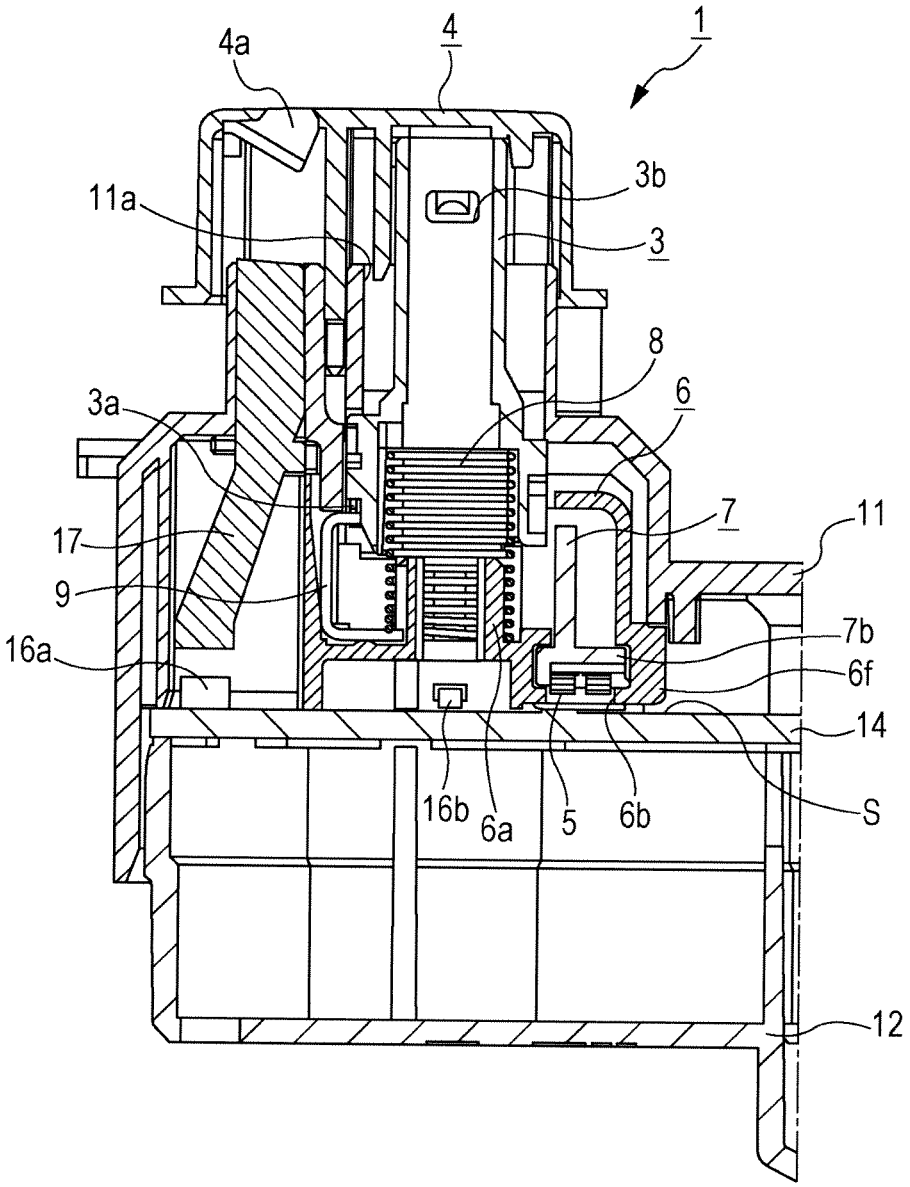
FIG. 6 is a longitudinal sectional view of the switch unit taken along the line VI-VI in FIG. 4.

The operating knob 4 may be provided with a pair of illumination portions 4*a* and 4*b*. The illumination portion 4*a* may function as an indicator indicating an ON state of the switch. Referring to FIG. 6, the illumination portion 4*a* may be illuminated with light emitted from a light source (for example, a light emitting diode (LED)) 16*a* on the circuit board 14 and guided by a light guide 17. The other illumination portion 4*b* may indicate the position of the operating knob 4 in a dark place. The illumination portion 4*b* may be illuminated with light emitted from another light source (for example, a LED) 16*b* on the circuit board 14 and passed through a hollow of the operating slider 3.

According to the various embodiments, in an OFF state of the push switch 1, when a user pushes the operating knob 4 downward, the operating slider 3 may be slid in the push operation direction (or moved downward), and the actuator 7 may be driven by the operating slider 3 to slide in one direction on the upper surface of the circuit board 14. Consequently, the sliding member 5 attached to the actuator 7 may be slid on the circuit board 14 and may be separated from the fixed contact 10*a*, thus switching the OFF state to the ON state. Simultaneously, the engagement pin 9 may enter a valley of a cam groove 3*a*, which will be described below, to prevent the operating slider 3 from returning, so that the push switch 1 may be locked to the ON state. In the ON state, when the user pushes the operating knob 4, the engagement pin 9 may be disengaged from the valley of the cam groove 3*a* to unlock the locked state, so that the operating slider 3 is slid in the direction opposite to the push operation direction (or moved upward) by the elastic restoring force of the return spring 8. Accordingly, the actuator 7 may be driven by the operating slider 3 to slide in the opposite direction on the upper surface of the circuit board 14. Consequently, the sliding member 5 may be slid together with the actuator 7 on the circuit board 14 and may be brought into contact with the fixed contact 10*a*, so that the push switch 1 is returned to the OFF state.

The configuration of the push switch 1 will be described in detail. The operating slider 3 may have an engagement hole 3*b* disposed in an upper portion of each of side walls facing each other. Engagement protrusions (not illustrated) of the operating knob 4 may be snap-fitted in the engagement holes 3*b*, so that the operating knob 4 caps the operating slider 3. As will be described later, when the main body 2 of the push switch 1 is attached to the upper casing 11, the operating slider 3 may extend through an opening 11*a* (refer to FIG. 3) of the upper casing 11. In this state, therefore, the operating knob 4 can cap the operating slider 3.

Lower part of the operating slider 3 may be shaped in a rectangular column thicker than upper part thereof. The cam groove 3*a* which may be heart-shaped and a pair of protrusions 3*c* may be arranged in one of four side walls of the thicker part (refer to FIG. 8). In addition, another side wall (refer to FIG. 9) facing the side wall having the cam groove 3*a* may be provided with a first inclined guide surface 3*e* and a second inclined guide surface 3*f* such that the guide surfaces sandwich a recessed groove 3*d* extending obliquely. The first inclined guide surface 3*e* may correspond to an upper inner surface of the recessed groove 3*d* and the second inclined guide surface 3*f* may correspond to a lower inner surface of the recessed groove 3*d*. The other two side walls (refer to FIG. 10) each may be provided with a pair of guide rails 3*g* extending straight in the longitudinal direction. In the housing 6, the engagement pin 9 may be disposed in a space between the pair of protrusions 3*c* of the operating slider 3. Referring to FIG. 6, the one end of the engagement pin 9 may be journaled by the housing 6 and the other end (engagement end) of the engagement pin 9 may be engaged with the cam groove 3*a*. The engagement end of the engagement pin 9 may be slid along the cam groove 3*a* in accordance with the sliding (upward or downward movement) of the operating slider 3. When the engagement end of the engagement pin 9 enters the valley, indicated at P, (refer to FIG. 8) of the cam groove 3*a*, the upward movement of the operating slider 3 is prevented. In other words, the cam groove 3*a* disposed in the operating slider 3 and the engagement pin 9 journaled by the housing 6 may constitute a heart cam mechanism that may lock or unlock the operating slider 3 in an ON position.

The return spring 8 may be a compression coil spring. Referring to FIG. 6, the return spring 8 may be supported by a spring receiving portion 6*a* raised on the inner bottom of the housing 6. The return spring 8 may be placed within the thicker part of the operating slider 3. The operating slider 3 may be upwardly urged while receiving the elastic force of the return spring 8.

Figure 12:
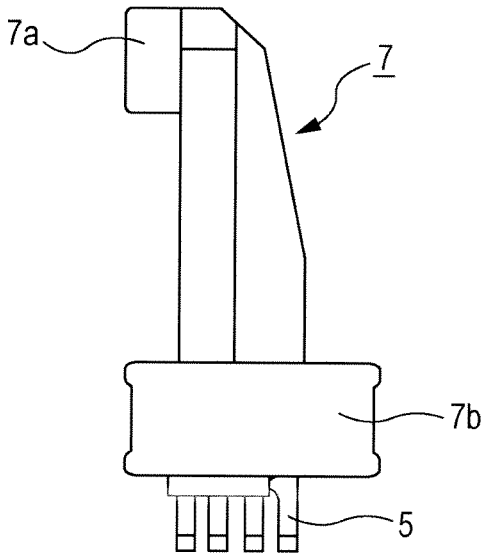
FIG. 12 is a side elevational view of the actuator when viewed from a direction in which the actuator is slid.

The actuator 7 may be incorporated in one side portion of the housing 6. As illustrated in FIGS. 1 and 12, a driven portion 7*a* may be disposed in upper part of the actuator 7 such that the driven portion 7*a* laterally projects from the actuator 7. The driven portion 7*a* may be placed in the recessed groove 3*d* of the operating slider 3 such that the driven portion 7*a* may be slidable on the first inclined guide surface 3*e* and the second inclined guide surface 3*f*. Also, when the operating slider 3 is moved downward, the driven portion 7*a* may be pressed downward by the first inclined guide surface 3*e*, so that the driven portion 7*a* is moved obliquely downward along the recessed groove 3*d* while being slid on the first inclined guide surface 3*e*. On the contrary, when the operating slider 3 is moved upward, the driven portion 7*a* may be pressed upward by the second inclined guide surface 3*f*, so that the driven portion 7*a* is moved obliquely upward while being slid on the second inclined guide surface 3*f*. In addition, the sliding member 5, serving as a movable contact, may be attached to a bottom plate 7*b* of the actuator 7. The sliding member 5 may be in elastic contact with the circuit board 14 at all times. As described above, the sliding member 5 may be allowed to be brought into contact with and separated from the fixed contact 10*a* and may be in contact with the fixed contact 10*b* at all times. In this embodiment, a state in which the fixed contacts 10*a* and 10*b* are held in conduction through the sliding member 5 is the OFF state and a state in which the sliding member 5 is separated from the fixed contact 10*a* to bright the contacts 10*a* and 10*b* out of conduction is the ON state. Note that the state in which the sliding member 5 is in contact with the fixed contact 10*a* may be regarded as the ON state according to the intended use of the push switch 1.

Figure 5:
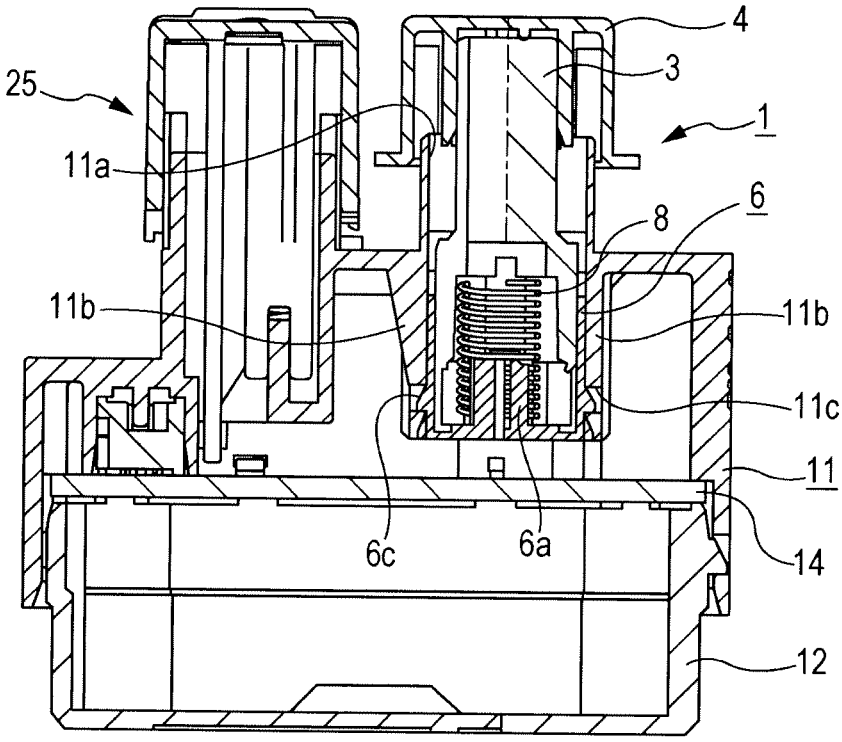
FIG. 5 is a longitudinal sectional view of the switch unit taken along the line V-V in FIG. 4.
Figure 7:
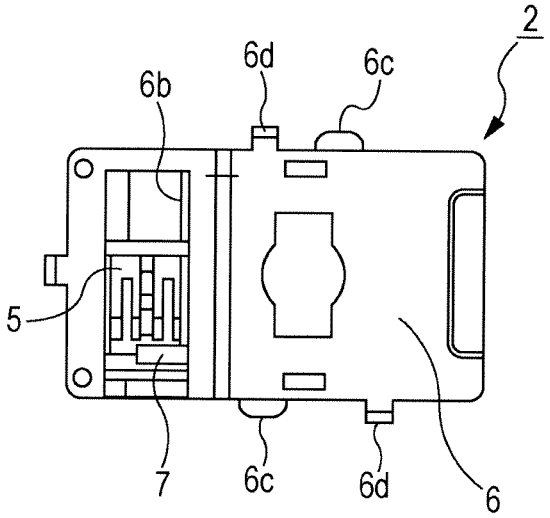
FIG. 7 is a bottom view of a main body of the push switch of FIG. 3.

Referring to FIG. 6, the housing 6 may receive the actuator 7, the return spring 8, the engagement pin 9, and the like. The sliding member 5 may be exposed in a notch 6*b* disposed on the bottom of the housing 6. Referring to FIG. 7, the housing 6 may include an engagement hook 6*c* and a positioning projection 6*d* projecting from the outer surface of one side wall thereof. The outer surface of a side wall opposite the above side wall may also be provided with an engagement hook 6*c* and a positioning projection 6*d*. Referring to FIG. 5, the upper casing 11 may include an attachment frame 11*b* such that the attachment frame 11*b* extends vertically upwardly and downwardly therefrom and the attachment frame 11*b* may have fastening holes 11*c*. The housing 6 may be inserted from below into the upper casing 11 and each engagement hook 6*c* may be snap-fitted into the corresponding fastening hole 11*c*, so that the housing 6 is attached to the upper casing 11. At this time, the positioning projections 6*d* may be inserted into restricting grooves (not illustrated) arranged on the attachment frame 11*b*, so that the housing 6 can be smoothly inserted up to a predetermined position into the upper casing 11 and be snap-fitted. The positioning projections 6*d* may prevent the housing 6 from rattling in the upper casing 11. When the circuit board 14 is attached to an outer casing, e.g., the upper casing 11, the housing 6 fixed in the predetermined position in the upper casing 11 may be positioned above the circuit board 14 as illustrated in FIG. 5, thus providing a space S (refer to FIG. 6), in which the sliding member 5 projects, between the housing 6 and the circuit board 14.

As described above, the housing 6 may support the operating slider 3 such that the operating slider 3 is slidable upward and downward and also supports the actuator 7 such that the actuator 7 is slidable laterally. The housing 6 may include restricting projections 6*e* (as shown in FIG. 1, for example) projecting from the inner surfaces of side walls facing each other, respectively. Each restricting projection 6*e* may extend between the corresponding pair of guide rails 3*g* of the operating slider 3. Accordingly, the operating slider 3 can be smoothly moved upward or downward without tilting. The housing 6 further may include a pair of rail-shaped wall portions 6*f* (refer to FIG. 6) arranged on the bottom thereof such that the portions 6*f* extend substantially parallel to each other. The bottom plate 7*b* of the actuator 7 may be slidably held between the rail-shaped wall portions 6*f*. Accordingly, the bottom plate 7*b* of the actuator 7 may be smoothly slidable along the rail-shaped wall portions 6*f*.

Figure 8:
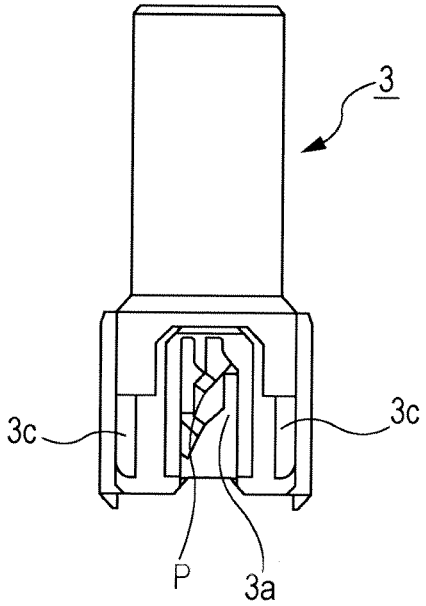
FIG. 8 is a side elevational view of an operating slider included in the push switch and illustrates one side thereof with a heart-shaped cam groove.
Figure 9:
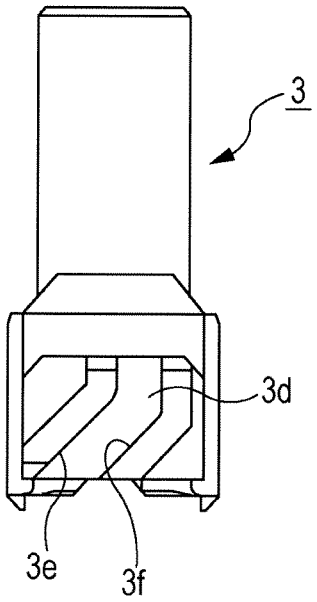
FIG. 9 is a side elevational view of the operating slider and illustrates another side thereof with an actuator driving surface.
Figure 10:
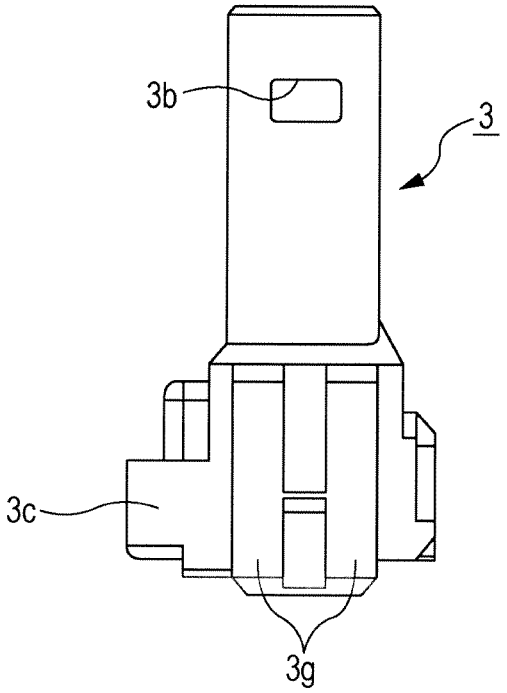
FIG. 10 is a side elevational view of the operating slider and illustrates another side thereof with guide rails.
Figure 11:
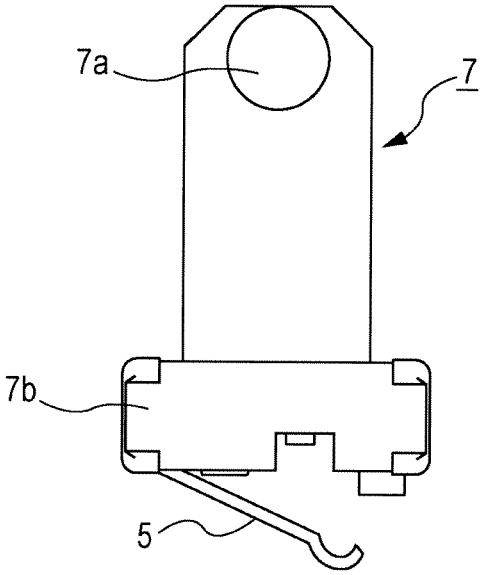
FIG. 11 is a side elevational view of an actuator included in the push switch and illustrates one side thereof with a driven portion.

Referring to FIGS. 5 and 6, when the push switch 1 is in the OFF state, the level of the operating slider 3 may be the highest such that the amount of projection from the opening 11*a* of the upper casing 11 is at the maximum. The fixed contacts 10*a* and 10*b* are held in conduction through the sliding member 5. In such a state, when the user pushes the operating knob 4 downward, the first inclined guide surface 3*e* presses the driven portion 7*a* of the actuator 7 downward in accordance with the downward movement of the operating slider 3. Thus, the driven portion 7*a* may be moved obliquely downward along the recessed groove 3*d*, so that the actuator 7 is slid together with the sliding member 5 in one direction (so as to move away from the seesaw switch 25) on the circuit board 14. When the sliding member 5 slid on, the circuit board 14 may be separated from the fixed contact 10*a*, the fixed contacts 10*a* and 10*b* may be brought out of conduction, so that the push switch 1 enters the ON state. Further, the engagement end of the engagement pin 9 may be relatively moved upward from the bottom of the heart-shaped cam groove 3*a* in accordance with the downward movement of the operating slider 3. When the user pushes the operating slider 3 up to the lowest level and then releases the operating physical force, the operating slider 3 is slightly moved upward by the elastic restoring force of the return spring 8, so that the engagement end of the engagement pin 9 enters the valley P of the cam groove 3*a* (as shown in FIG. 8, for example). Accordingly, the engagement pin 9 may prevent the operating slider 3 from further returning. The operating slider 3 may be locked in a level lower than the level of the operating slider 3 in FIG. 5. Thus, the push switch 1 may be held (locked) in the ON state.

When the user pushes the operating slider 3 locked in the ON state to the lowest level, the engagement end of the engagement pin 9 may be disengaged from the valley P of the cam groove 3*a* to unlock the locked state. Accordingly, the operating slider 3 may be moved upward to the original level, illustrated in FIGS. 5 and 6, by the elastic restoring force of the return spring 8. The second inclined guide surface 3*f* may upwardly press the driven portion 7*a* of the actuator 7 in accordance with the upward movement of the operating slider 3, so that the driven portion 7*a* may be moved obliquely upward along the recessed groove 3*d* and the actuator 7 may be slid together with the sliding member 5 in the opposite direction (so as to be closer to the seesaw switch 25) on the circuit board 14. When the sliding member 5 is slid onto the fixed contact 10*a*, the fixed contacts 10*a* and 10*b* are again brought into conduction, so that the push switch 1 returns to the OFF state.

As described above, the push switch 1 may have such a configuration that the housing 6 may be attached to the upper casing 11, serving as an outer casing of the push switch 1, the space S may be provided between the housing 6 and the circuit board 14, an operating load applied to the operating slider 3 therefore acts on the robust outer casing, e.g., the upper casing 11, through the housing 6, and the operating load hardly acts on the circuit board 14. Accordingly, even if an excessive operating load is applied to the operating slider 3, there is no fear of occurrence of damage, e.g., a crack in a soldered joint caused by deflection of the circuit board 14. An increase of reliability or durability therefore can be expected. Moreover, since the space S is provided between the housing 6 and the circuit board 14, for example, a circuit pattern and electronic components can be arranged in an area in the space S, thus increasing an effective area of the circuit board 14. Consequently, the circuit board 14 can be easily miniaturized and the flexibility of designing circuitry can also be increased. Further, in the push switch 1 with the above-described configuration, if the position of the fixed contact 10*a* on the circuit board 14 is shifted, the timing when the sliding member 5 is brought into contact with or separated from the fixed contact 10*a* can be changed. Advantageously, the timing when the push switch 1 enters the ON state can be easily controlled according to the intended use of the push switch 1.

Note that the actuator 7 may be slid in the direction substantially orthogonal to the push operation direction to switch the push switch 1 between the ON and OFF states. Accordingly, when the actuation stroke for the operating slider 3 is set to long, the height of the housing 6 can be prevented from increasing. Further, the heart cam mechanism provided for the push switch 1 allows the engagement pin 9 journaled by the housing 6 to be slid along the cam groove 3*a* disposed in the operating slider 3 in accordance with the push operation. Accordingly, the heart cam mechanism may function as a lock mechanism with a simple configuration and good space factor.

In the push switch 1 according to various embodiments, the engagement hooks 6*c* of the housing 6 may be snap-fitted into the fastening holes 11*c* of the attachment frame 11*b* included in the upper casing 11, serving as the outer casing, so that the housing 6 may be fixed to the attachment frame 11*b*. Advantageously, the housing 6 can be easily attached in the predetermined position in the outer casing. Moreover, in the embodiment, the main body 2 with the heart cam mechanism including the operating slider 3, the actuator 7, and the return spring 8 such that they are supported by the housing 6 is unitized. While the main body 2 is inserted into the outer casing, the housing 6 can be snap-fitted into the attachment frame 11*b*. Although the push switch 1 is designed such that the main body is attached into the outer casing, the workability of assembly of the push switch 1 is not complicated. The housing 6 of the main body 2 may be fixed, e.g., screwed to a proper portion of the outer casing.

In the push switch 1 according to various embodiments, the first and second inclined guide surfaces 3*e* and 3*f* facing each other with the recessed groove 3*d* therebetween may be arranged on one side surface of the operating slider 3 and the driven portion 7*a* of the actuator 7 is slidably disposed in the recessed groove 3*d*. With this arrangement, when the operating slider 3 may be moved downward, the first inclined guide surface 3*e* can press the driven portion 7*a* downward to move the actuator 7 in one direction on the circuit board 14, and when the operating slider 3 is moved upward, the second inclined guide surface 3*f* can press the driven portion 7*a* upward to move the actuator 7 in the opposite direction on the circuit board 14. Accordingly, the operating slider 3 and the actuator 7, which are slid in the directions substantially orthogonal to each other, can be drivingly connected to each other smoothly at all times. In addition, this arrangement provides a power converting mechanism with a simple configuration and good space factor.

Furthermore, the one side wall of the operating slider 3 provided with the first and second inclined guide surfaces 3*e* and 3*f* may be substantially parallel to the other side wall thereof provided with the cam groove 3*a* of the heart cam mechanism. Accordingly, the actuator 7 may be disposed in a space where the one side wall of the operating slider 3 faces in the housing 6 and the engagement pin 9 is disposed in a space where the other side wall of the operating slider 3 faces therein. Consequently, the actuator 7 and the engagement pin 9 can be arranged relative to the operating slider 3 in a balanced manner, the actions of the push switch 1 can be easily stabilized, and the housing 6 can be easily made compact.

The embodiment uses the heart cam mechanism in which the cam groove 3*a* is disposed in the operating slider 3 and the engagement pin 9 is journaled by the housing 6. Another heart cam mechanism in which, for example, the cam groove is disposed in the housing and the engagement pin is journaled by the operating slider may be used.

Accordingly, the embodiments of the present inventions are not to be limited in scope by the specific embodiments described herein. Further, although some of the embodiments of the present invention have been described herein in the context of a particular implementation in a particular environment for a particular purpose, those of ordinary skill in the art should recognize that its usefulness is not limited thereto and that the embodiments of the present inventions can be beneficially implemented in any number of environments for any number of purposes. Accordingly, the claims set forth below should be construed in view of the full breadth and spirit of the embodiments of the present inventions as disclosed herein. While the foregoing description includes many details and specificities, it is to be understood that these have been included for purposes of explanation only, and are not to be interpreted as limitations of the invention. Many modifications to the embodiments described above can be made without departing from the spirit and scope of the invention.

What is claimed is:

1. A push switch comprising:

an operating slider integrated with an operating member, the operating slider having an inclined guide surface extending obliquely on one side wall thereof;

a housing supporting the operating slider such that the operating slider is slidable in a push operation direction;

an actuator supported in the housing, the actuator including a driven portion slidable on the inclined guide surface, the actuator being driven by the operating slider to be slidable in a direction substantially orthogonal to the push operation direction;

a conductive sliding member attached to the actuator such that the sliding member is exposed on the housing;

a return spring supported in the housing such that the return spring elastically urges the operating slider in the direction opposite to the push operation direction at all times;

a heart cam mechanism including a cam groove provided for either one of a side wall opposite the one side wall of the operating slider and the housing and an engagement pin journaled by the other one such that the engagement pin is slidably engaged with the cam groove;

a fixed contact provided for a circuit board such that the sliding member is allowed to be brought into contact with and separated from the fixed contact; and an outer casing holding the circuit board, wherein the outer casing is separate from the housing and the housing is fixed to the outer casing to dispose the housing apart from the circuit board and bring the sliding member into elastic contact with the circuit board.

2. The push switch according to claim 1, wherein the outer casing includes an attachment frame such that the attachment frame extends vertically upwardly and downwardly therefrom, the attachment frame has a fastening hole, the housing includes an engagement hook protruding from the outer surface of a side wall thereof, and the engagement hook is snap-fitted into the fastening hole to fix the housing to the attachment frame.

3. The push switch according to claim 1, wherein a first inclined guide surface and a second inclined guide surface facing each other with a recessed groove extending obliquely therebetween are provided for the one side wall of the operating slider, the driven portion disposed in the recessed groove is driven by the first inclined guide surface in accordance with the movement of the operating slider in the push operation direction to move in one direction along the recessed groove, and the driven portion is driven by the second inclined guide surface in accordance with the movement of the operating slider in the direction opposite to the push operation direction to move in the opposite direction along the recessed groove.

4. The push switch according to claim 3, wherein the first and second inclined guide surfaces are provided for one of substantially parallel side walls of the operating slider and the other side wall faces the engagement pin.

* * * * *